US011214092B2

(12) United States Patent
Hosoya

(10) Patent No.: US 11,214,092 B2
(45) Date of Patent: Jan. 4, 2022

(54) KNOCKING-TYPE WRITING INSTRUMENT EQUIPPED WITH ERASER

(71) Applicant: MICRO CO., LTD., Tokyo (JP)

(72) Inventor: Tomohiro Hosoya, Fukushima-ken (JP)

(73) Assignee: MICRO CO., LTD.

( * ) Notice: Subject to any disclaimer, the term of this patent is extended or adjusted under 35 U.S.C. 154(b) by 56 days.

(21) Appl. No.: 16/913,063

(22) Filed: Jun. 26, 2020

(65) Prior Publication Data

US 2021/0001661 A1 Jan. 7, 2021

(30) Foreign Application Priority Data

Jul. 1, 2019 (JP) ..... JP2019-122779
Nov. 26, 2019 (JP) ..... JP2019-213641

(51) Int. Cl.
*B43K 29/02* (2006.01)
*B43K 21/16* (2006.01)
*B43K 21/00* (2006.01)

(52) U.S. Cl.
CPC ..... *B43K 29/02* (2013.01); *B43K 21/006* (2013.01); *B43K 21/16* (2013.01)

(58) Field of Classification Search
CPC ..... B43K 29/02; B43K 21/00; B43K 21/02; B43K 21/006; B43K 21/16; B43K 21/22
See application file for complete search history.

(56) References Cited

U.S. PATENT DOCUMENTS 6,126,350 A * 10/2000 Kageyama ..... B43K 21/00 401/53
9,914,322 B2 3/2018 Soejima ..... 24/3
2003/0113154 A1* 6/2003 Arai ..... B43K 21/22 401/93
2005/0276652 A1* 12/2005 Kanari ..... B43K 24/084 401/109
2007/0025801 A1* 2/2007 Kanari ..... B43K 21/22 401/93
2012/0230751 A1* 9/2012 Noguchi ..... B43K 21/24 401/65
2015/0030369 A1* 1/2015 Hosoya ..... B43K 21/00 401/65
2019/0064943 A1* 2/2019 Chang ..... G06F 3/03545

* cited by examiner

*Primary Examiner* — J C Jacyna
(74) *Attorney, Agent, or Firm* — Adams & Wilks

(57) ABSTRACT

A knocking-type writing instrument has a writing refill, such as a pencil lead or an ink cartridge, that is advanced by knocking a knocking member, and an eraser held by an eraser holder disposed at a rear part of the knocking member. When the writing instrument is inclined so that the eraser side faces downward, a control pin provided in the eraser holder and a movable stopper drop by their own weights along a sliding groove of the knocking member. When the control pin drops a predetermined distance and enters a circumferential locking groove provided at a rear end of the sliding groove, detachment of the control pin is prevented by the stopper, and the eraser holder is unable to retract to the inside of the knocking member. In this state, a radial projection on the control pin abuts a rear end face of the knocking holder, whereby the knocking member is locked and can no longer be knocked, and feeding of the writing refill is prevented.

8 Claims, 13 Drawing Sheets

FIG. 9 (A)
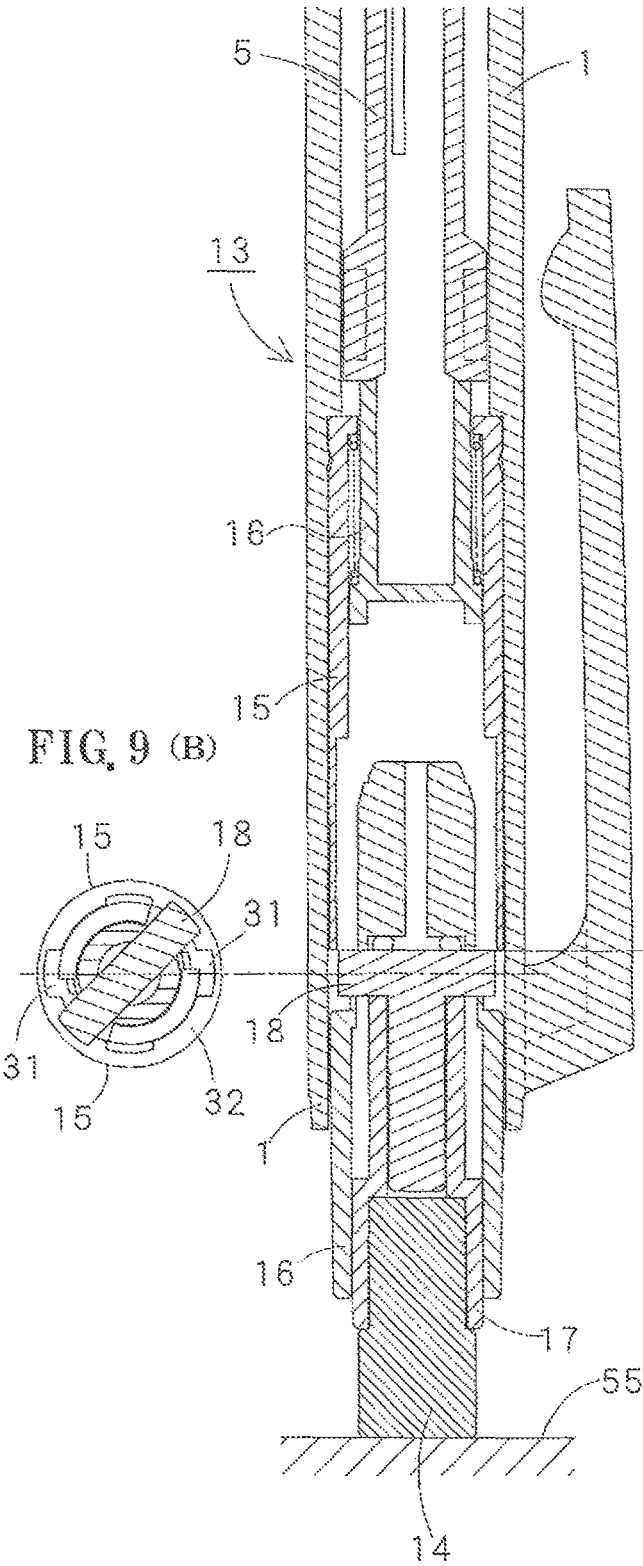
FIG. 9 (B)
FIG. 9 (C)
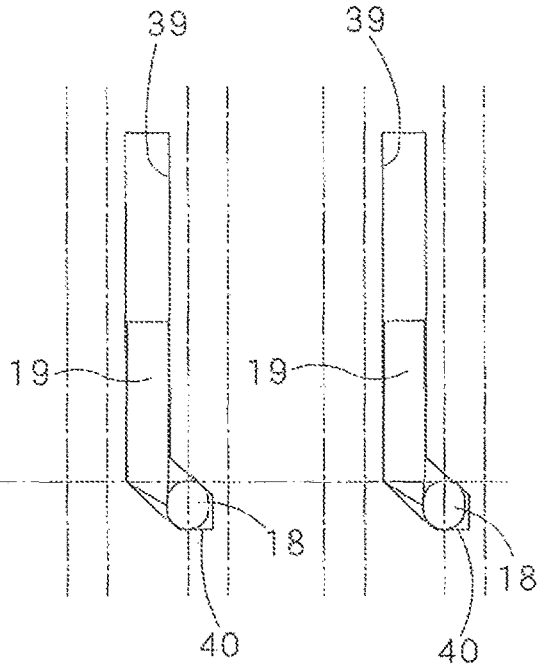

KNOCKING-TYPE WRITING INSTRUMENT EQUIPPED WITH ERASER

FIELD OF THE INVENTION

The present invention relates to a knocking-type writing instrument equipped with an eraser, in which feeding of a refill is conducted by moving a knocking member having an eraser forward by a knocking operation, and in which the knocking member is rendered inoperative when the eraser is used.

BACKGROUND INFORMATION

As writing instruments in which a refill, such as a lead refill for a mechanical pencil or an ink refill for a ball point pen, is fed by knocking a knocking member, writing instruments having an eraser provided at the knocking member for erasing what has been written on a paper by projecting the eraser from a rear end of a writing instrument body have been widely used. As a structure for installing the eraser, writing instruments in which the eraser is projected from and retracted into the knocking member have been known, wherein when the writing instrument body is inclined so that the front end of the writing instrument faces upward away from paper, the eraser faces downward and projects from the knocking member by its own weight, and when the writing instrument body is inclined so that the front end of the writing instrument faces downward close to the paper, the eraser retracts downwardly in the knocking member by its own weight. Further, other writing instruments in which an eraser is attached to the knocking member in a fixed state so that the eraser always projects rearwardly from the knocking member have also been known.

The knocking member of the knocking-type writing instrument is set to be movable forward and backward within the writing instrument body, usually positioned at the retracted position and urged in the rearward direction of the writing instrument body by a spring, and when it is knocked against the spring, it advances to conduct refill feeding. As such, at the time of using the eraser, when the eraser is pressed strongly and the knocking member advances against the spring, the refill may be undesirably fed. Accordingly, various types of locking mechanisms have been proposed, wherein at the time of using the eraser, even if a strong force is applied, the eraser is not allowed to move.

For example, Japanese Patent No. 6045651 and U.S. Pat. No. 9,914,322 describe writing instruments having a structure in which an eraser is retracted in a writing instrument body in a writing state, but when the eraser side is oriented to face downwardly, the eraser projects out of the writing instrument body by its own weight and can be used. In the writing instruments described in the above publications, a connecting member is press-fitted into a rear end of a lead tank of a lead feeding-mechanism, a retract unit is connected to the connecting member, and an advancing-and-retreating member having a holder or a retract piece such as an eraser are provided in the retract unit. When the retract piece (eraser) side is oriented to face downward, the advancing and retreating member slides downwardly in the holder and rolling elements are fitted in recessed parts formed on a slide shaft of the advancing-and-retreating member to bridge between the holder and the advancing-and-retreating member. And, a catching-and-releasing member slidably moves toward the downward side and embraces the outer periphery of the rolling elements, by which the advancing-and-retreating member, i.e., the retract piece such as an eraser attached to the advancing-and-retreating member, is engaged so as not to move backward.

A support case that holds the retract unit has a projection on its side face, and the projection is fitted in a vertical groove formed on an inner face of a shaft tube so as to move forward. In the vertical groove, the rear end is opened, and the front end is closed within the shaft tube, and therefore the retract unit is allowed to move forward until the projection abuts on the front end.

Referring to the drawings of the above publications, in a state where a retract member (eraser) is used, a space is formed between the projection provided on the support case and the front end of the vertical groove. Accordingly, when the retract member (eraser) is compressed against the paper, the press force is transferred to the retract unit, and the lead tank is directly pressed through the connecting member and advances. This advance movement is equal to the one made by the knocking operation of the lead-feeding mechanism. As a result, although not intended to conduct writing, the lead is incidentally fed from the front end of the writing instrument body. At this time, the eraser also retracts into the shaft tube together with the retract unit, and therefore the erasing operation by the eraser is not conducted efficiently.

Further, in knocking-type writing instruments, the lead tank constituting the lead-feeding mechanism is usually urged rearward by a chuck spring. When the hardness of a refill lead of the writing instrument is low, in order to protect the lead, the force of the chuck spring is adjusted to be weak, and therefore even if the force applied by the eraser for erasing is weak, the lead tank may easily advance to feed the lead.

In a case of writing instruments having an eraser attached to a knocking member in a fixed state as well, if no locking mechanism for the knocking member is provided, when the eraser is used, the knocking member is knocked and the refill may sometimes be made to protrude, similarly to the knocking-type writing instruments having the retract-type eraser as described in the above publications.

SUMMARY OF THE INVENTION

It is an object of the present invention to overcome the aforementioned drawbacks and disadvantages of prior art knocking-type writing instruments by providing a knocking-type writing instrument equipped with an eraser, in which when a writing instrument body is inclined so that the front end of the writing instrument is positioned to face upward away from a writing paper and an eraser provided on a knocking member is used, the movement of the knocking member is locked, and even if the eraser is rubbed or pressed on the paper, the knocking member does not advance and feeding of a lead is prevented. On the other hand, when the writing instrument body is inclined so that the front end of the writing instrument is positioned to face downward in readiness to make contact with the paper, the refill can be fed by a knocking operation as usual.

The present invention provides a knocking-type writing instrument equipped with an eraser, comprising a writing instrument body which houses a refill; a knocking member inserted movably in the writing instrument body to move in a forward and backward direction to feed the refill, the knocking member having sliding grooves extending in the forward and backward direction and a locking groove extending in a circumferential direction from a rear end of the sliding grooves; an eraser held at a rear part of the knocking member; a control pin fitted in and movable between the sliding grooves and the locking groove of the knocking member, an outward end of the control pin extending in a radial direction of the writing instrument body; a movable stopper inserted into a forward side of the sliding grooves in which the control pin is fitted, the movable stopper being freely movable in the forward and backward direction in the sliding grooves; and an abutment part provided in the writing instrument body and on which an outward end of the control pin abuts to prevent advance movement of the control pin when the control pin is fitted in the locking groove.

As used in the present disclosure, "front", "front part", "forward" and "tip" represent the direction in which the front end of the refill of the writing instrument moves to project out of the writing instrument body, and "rear", "rear part" and "rearward" represent the direction in which the front end of the refill of the writing instrument moves to retract into the writing instrument body.

The present invention also provides a knocking-type writing instrument equipped with an eraser, wherein the locking groove that extends in a circumferential direction from the rear end of the sliding grooves is inclined backward relative to an imaginary central axis of the knocking member, by which it is possible to install the eraser held at the rear part of the knocking member to project backwardly from or retract forwardly into the knocking member, or wherein the eraser is attached in a fixed state to the knocking member.

In the present invention as constructed above, the knocking member is inserted movably in a forward and backward direction into the body housing the refill, and an eraser is provided at the rear part of the knocking member. The knocking member has sliding grooves extending in a forward and backward direction and a locking groove extending in a circumferential direction from the rear end of the sliding grooves. A control pin is provided in such a way that it moves between the sliding grooves and the locking groove, and a movable stopper freely movable in the forward and backward direction is inserted into the forward side of the sliding grooves. When the writing instrument body is inclined so that the front end of the writing instrument is positioned to face upward and the eraser is positioned to face downward, the control pin and the movable stopper will drop downwardly by their own weights along the sliding grooves. When the control pin reaches the position which corresponds to the locking groove, the control pin enters the locking groove from the sliding grooves and turns slightly in a circumferential direction. When the control pin enters the locking groove, the movable stopper which has dropped together with the control pin stops at a position adjacent to the control pin and closes the opening part of the locking groove. As a result, the control pin cannot slip out of the locking groove. At this time, the outward end of the control pin abuts on the abutment part provided in the writing instrument body, thereby preventing the advance movement of the control pin, and therefore the knocking member can no longer advance. Since the advance movement of the knocking member is locked as explained above, the refill is no longer fed during the use of the eraser.

The locking groove extending in a circumferential direction from the rear end of the sliding groove is inclined rearwardly relative to the imaginary central axis of the knocking member. When the control pin drops within the sliding grooves by its own weight and reaches the opening part of the locking groove, the control pin easily enters the locking groove. Further, at the time of using the writing instrument, when the front end of the writing instrument is oriented to face downward, the control pin can easily return to the sliding grooves from the locking groove, and therefore the writing instrument can be used without difficulty.

BRIEF DESCRIPTION OF THE DRAWINGS

FIGS. 2A-2C show a knocking holder, wherein FIG. 2A is a front view, FIG. 2B is a cross-sectional view and FIG. 2C is a right side view.

FIGS. 3A-3D show a knocking member, wherein FIG. 3A is a plane view, FIG. 3B is a front view, FIG. 3C is a cross-sectional view and FIG. 3D is a right side view.

FIGS. 4A-4C show an eraser holder, wherein FIG. 4A is a plane view, FIG. 4B is a front view and FIG. 4C is a cross-sectional view.

FIGS. 5A-5C show a control pin, wherein FIG. 5A is a front view, FIG. 5B is a right side view and FIG. 5C is a plane view.

FIGS. 6A-6D show a movable stopper, wherein FIG. 6A is a plane view, FIG. 6B is a front view, FIG. 6C is a cross-sectional view and FIG. 6D is a right side view.

FIGS. 7A-7C are explanatory views showing a state where an eraser side of the writing instrument is oriented to face downward, but the eraser is not yet projected from the writing instrument body, wherein FIG. 7A is an explanatory view showing a relation between the eraser holder and the writing instrument body, FIG. 7B is an explanatory view showing a state where the control pin is fitted in a guide groove of the knocking holder, and FIG. 7C is an explanatory view showing positions of both ends of the control pin and the movable stopper, both of which are fitted in sliding grooves.

FIGS. 8A-8C are explanatory views showing a state where the eraser side of the writing instrument is oriented to face downward and the eraser is projected from the writing instrument body, wherein FIG. 8A is an explanatory view showing a relation between the eraser holder and the writing instrument body, FIG. 8B is an explanatory view showing a state where the control pin has slipped out of the guide groove of a knocking holder and turned slightly, and FIG. 8C is an explanatory view showing positions of both ends of the control pin and the movable stopper in a state where the control pin enters a locking groove and the movable stopper is adjacent to the control pin.

FIGS. 9A-9C are explanatory views showing a state where the eraser is pressed backwardly a little during its use and the control pin abuts on a rear end face (abutment part) of the knocking holder, wherein FIG. 9A is an explanatory view showing a relation between the eraser holder and the writing instrument body, FIG. 9B is an explanatory view showing a relation between the control pin and a rear end face of the knocking holder, and FIG. 9C is an explanatory view showing positions of both ends of the control pin and the movable stopper in a state where the control pin enters the locking groove and the movable stopper is adjacent to the control pin.

FIGS. 12A and 12B show a writing instrument body, wherein FIG. 12A is a cross-sectional view and FIG. 12B is a right side view.

FIG. 13A is a plane view, FIG. 13B is a front view, and FIG. 13C is a cross-sectional view.

FIGS. 14A-14C show a control pin, wherein FIG. 14A is a front view, FIG. 14B is a plane view and FIG. 14C is a cross-sectional view.

FIGS. 15A-15D show a movable stopper, wherein FIG. 15A is a plane view, FIG. 15B is a front view, FIG. 15C is a cross-sectional view and FIG. 15D is a right side view.

FIGS. 16A-16C are explanatory views showing a state where an eraser side of the writing instrument is oriented to face downward, but a control pin and a movable stopper have not yet dropped, wherein FIG. 16A is an explanatory view showing a relation of the control pin and the movable stopper with the writing instrument body, FIG. 16B is an explanatory view showing a state where the control pin is fitted in sliding grooves of a knocking member, and FIG. 16C is an explanatory view showing positions of both ends of the control pin and the movable stopper, both of which are fitted in the sliding grooves.

FIGS. 17A-17C are explanatory views showing a state where the eraser side of the writing instrument is oriented to face downward and a control pin and a movable stopper have dropped, wherein FIG. 17A is an explanatory view showing a relation between the knocking member and the writing instrument body, FIG. 17B is an explanatory view showing a state where a control pin is fitted in a locking groove and turned slightly, and FIG. 17C is an explanatory view showing positions of both ends of the control pin and the movable stopper in a state where the control pin enters the locking groove and the movable stopper is adjacent to the control pin.

FIGS. 18A-18C are explanatory views showing a state where the eraser is pressed rearwardly a little during its use and the control pin abuts on an abutment rib (abutting part) in the writing instrument body, wherein FIG. 18A is an explanatory view showing a relation between the control pin and the writing instrument body, FIG. 18B is an explanatory view showing a relation between the control pin and the abutment rib (abutting part), and FIG. 18C is an explanatory view showing positions of both ends of the control pin and the movable stopper in a state where the control pin enters the locking groove and the movable stopper is adjacent to the control pin.

DETAILED DESCRIPTION OF THE PREFERRED EMBODIMENTS

The present invention is applicable to a writing instrument having a refill, such as a mechanical pencil having a lead refill or a ball point pen having an ink refill, and may also be fitted to a feeding instrument of a rod-like body other than the refill. Further, the present invention may be fitted to a knocking-type writing instrument having an eraser attached to a knocking member in a fixed state or a knocking-type writing instrument having an eraser provided in a retractable fashion to project from and retract into a knocking member.

FIGS. 1-9 show an example of one embodiment of the present invention applied to a writing instrument in the form of a mechanical pencil having a project/retract type eraser. In this embodiment, the refill comprises a pencil lead refill.

Figure 1:
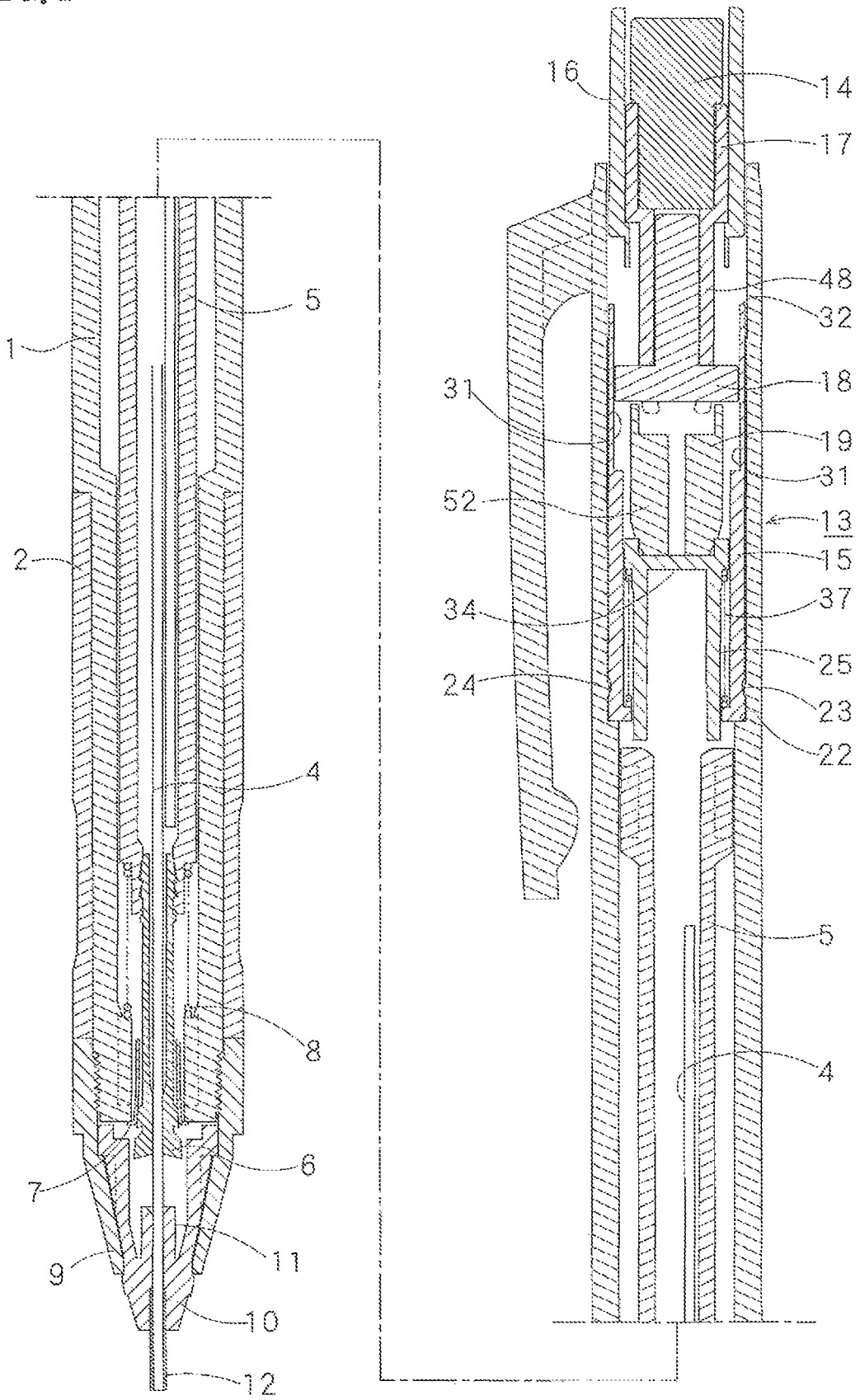
FIG. 1 is a cross-sectional view showing an example of a writing instrument in the form of a mechanical pencil according to the present invention, showing the writing instrument in a writing state.
Figure 2:
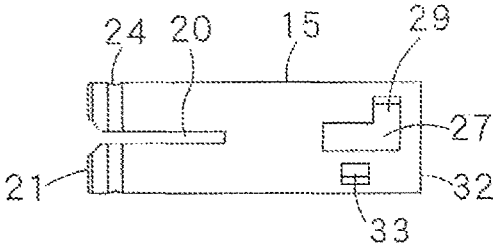
Figure 2:
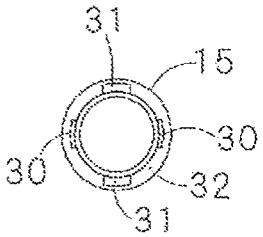
Figure 2:
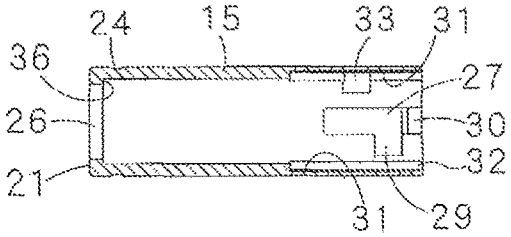
Figure 3:
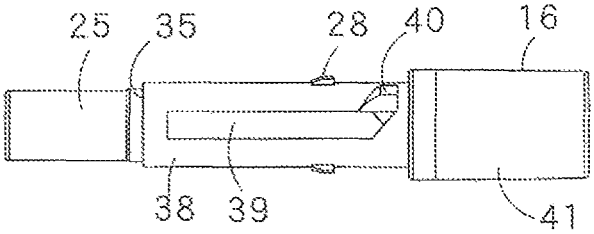
Figure 3:
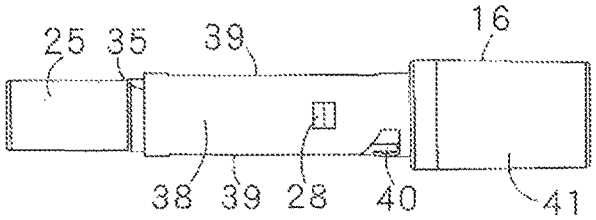
Figure 3:
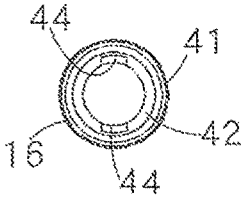
Figure 3:
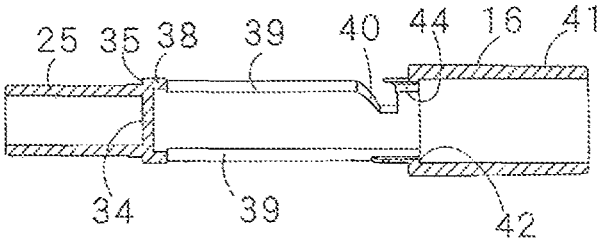
Figure 4:
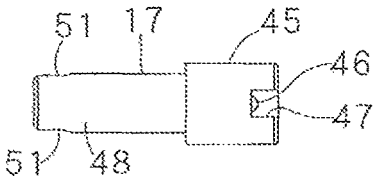
Figure 4:
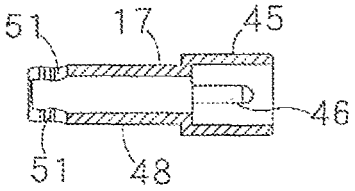
Figure 4:
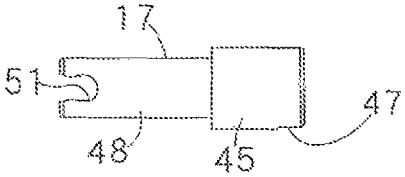
Figure 5:
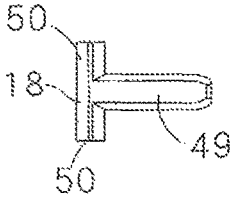
Figure 5:
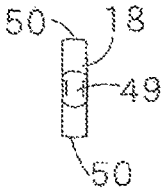
Figure 5:
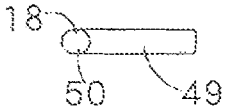
Figure 6:
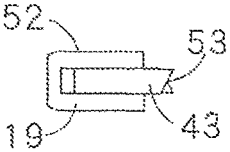
Figure 6:
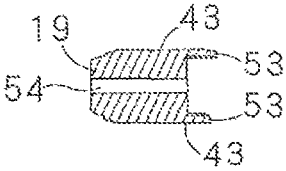
Figure 6:
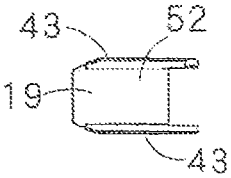
Figure 6:
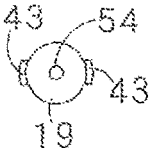
Figure 7:
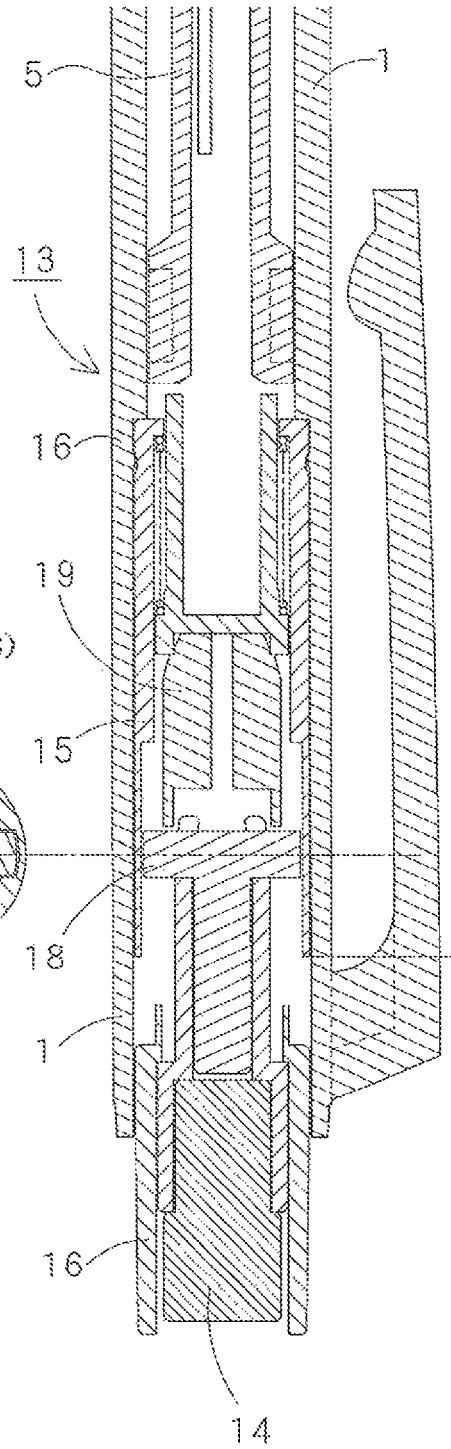
Figure 7:
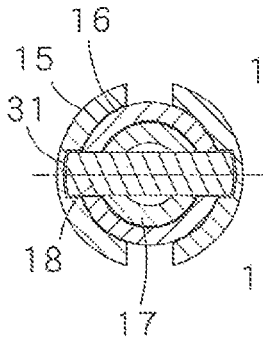
Figure 7:
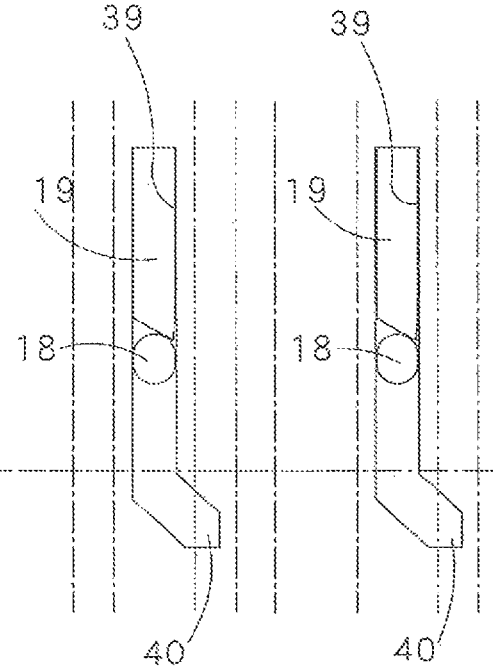
Figure 8:
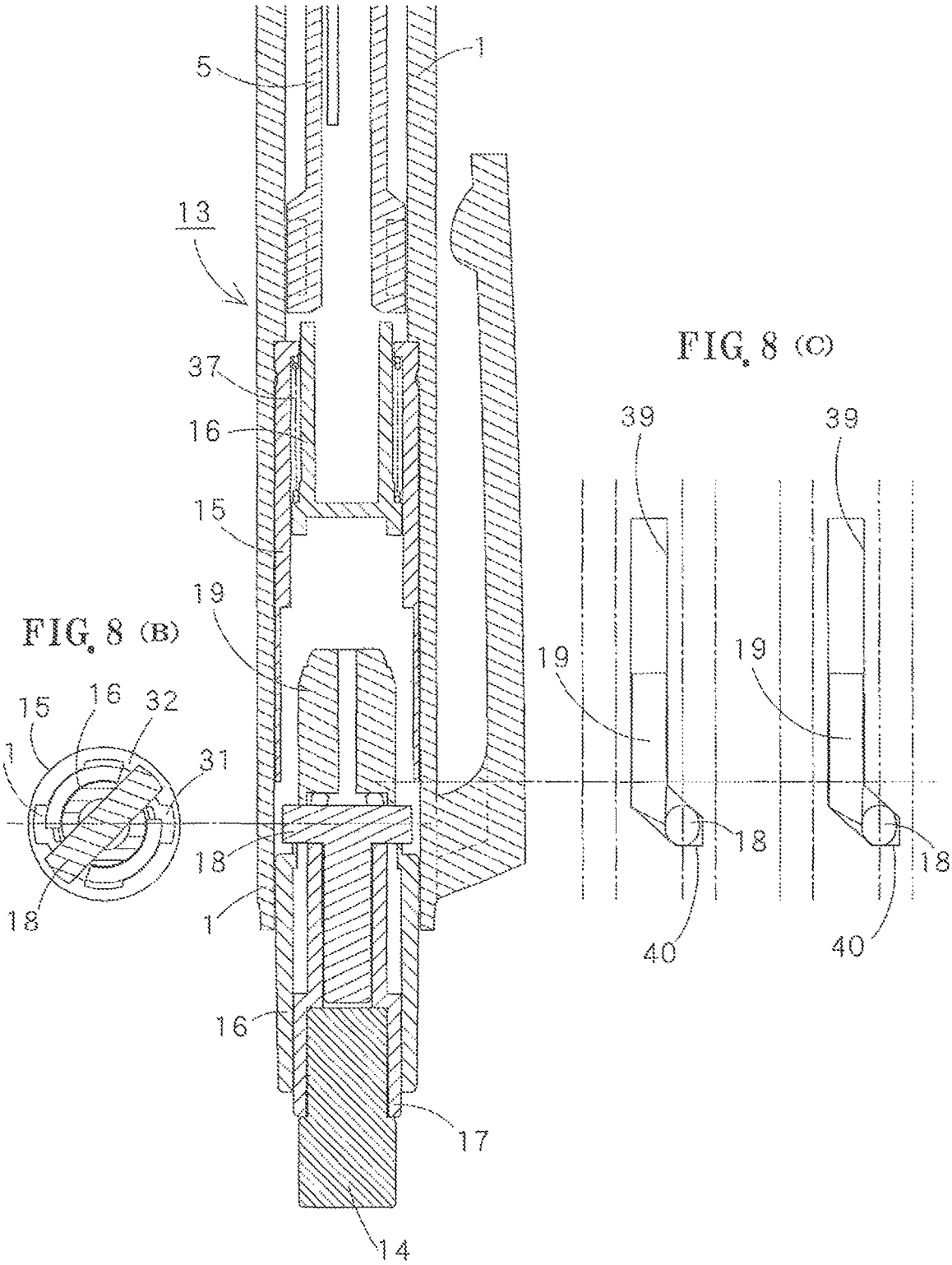

As illustrated in FIG. 1, the writing instrument has a tubular writing instrument body 1 having a grip 2 on its outer periphery. A lead refill 4 (sometimes referred to as simply "refill") is housed inside the writing instrument body 1.

As a knocking-type lead-feeding mechanism for a mechanical pencil, various types have been known. In the example shown in FIG. 1, in front of a lead tank 5 housing refill leads 4, a chuck 6 for releasably gripping and feeding one of the leads 4 and a clutch 7 for releasably engaging (fastening) the chuck are provided, and the lead tank 5 is urged rearwardly by a chuck spring 8. A tapered tip 9 is provided at the front end of the writing instrument body 1, and a front end bush 10 protrudes from the front end of the tapered tip. The front end bush 10 is provided with a guide tube 11 which temporarily holds and guides the fed lead 4 and a lead-protecting pipe 12 made of metal which protects the lead protruding from the front end of the writing instrument. As known in the art, when the lead tank 5 is knocked, the chuck 6 advances forwardly while gripping the lead, and during advancement the clutch 7 abuts on a stepped part provided at the front end bush 10 to release the chuck 6 so that the lead 4 is fed from the front end of the writing instrument in readiness for writing.

At the rear part of the writing instrument body 1, an eraser project/retract mechanism 13 is provided. As described below, the project/retract mechanism 13 holds an eraser 14 and when the eraser side of the writing instrument is oriented to face downward, the eraser drops by its own weight and projects from the rear of the writing instrument body 1 in readiness for use. The project/retract mechanism 13 shown in this example comprises a knocking holder 15 fixed inside the rear part of the writing instrument body 1 which houses the refill 4, a knocking member 16 inserted movably in a forward and backward direction inside the knocking holder 15 and urged rearwardly by a spring 37, an eraser holder 17 inserted freely movably in a forward and backward direction at the rear part of the knocking member 16 and holding the eraser 14, a control pin 18 provided at the front part of the eraser holder 17, and a movable stopper 19 positioned in front of the control pin 18.

As shown in FIGS. 2A, 2B and 2C, the knocking holder 15 is formed in a tubular shape and has a slit 20 and a front end part 21 which has an annular groove 24 on its outer periphery. The annular groove 24 is fixed by engaging with an annular projection 23 provided in the writing instrument body 1 in a state where the front end part 21 abuts on a stepped part 22 of the writing instrument body 1. At the front end part 21, a front end hole 26 is formed through which a front end tubular part 25 of the knocking member 16 can project. The peripheral part of the tubular-shaped knocking holder 15 is provided with two knocking grooves 27 extending in the forward and backward direction to determine the range of transfer (movement) of the knocking member 16. The knocking member 16 is provided with two locking projections 28 (see FIG. 3A) which are insertable into respective knocking grooves 27 of the knocking holder 15, and the knocking member 16 can be knocked within the predetermined range until the locking projections 28 abut on the front end of the knocking grooves 27.

The knocking grooves 27 and the locking projections 28 may be provided on the members reverse to the ones shown in this example, namely, the locking projections may be provided at the knocking holder 15 side and the knocking grooves may be provided at the knocking member 16 side.

At the rear end, preferably, of each knocking groove 27, a holding groove 29 is provided which extends in a circumferential direction and receives the locking projection 28.

And at the rear end side of each knocking groove 27, a slanting face 30 is provided to act as a guide when the locking projections 28 are inserted into the knocking grooves 27. In this embodiment, the locking projections are each formed in a substantially right-angled triangle shape as viewed from its side face, having a slanting face at its front end side.

On the inner face of the knocking holder 15, two guide grooves 31 extending in the forward and backward direction are formed so that the control pin 18 can slidably move therein, and the rear end of the guide grooves 31 open at a rear end face 32 of the knocking holder 15. The rear end face 32 of the knocking holder 15 opens at the rear end of the guide grooves 31, but closes in the circumferential direction of the opening part (see FIG. 2C). Accordingly, when the control pin 18 provided at the eraser holder 17 slips rearward out of the guide grooves 31 and is in a position facing the rear end face 32 in the circumferential direction of the opening part, the outward end of the control pin 18 (described later) of the eraser holder 17 abuts on the rear end face 32 of the knocking holder 15, and therefore even if it is attempted to move the knocking member 16 forward, the forward movement of the knocking member 16 will be unsuccessful. As mentioned above, the rear end face 32 of the knocking holder 15 constitutes an abutment part to prevent the advancement of the knocking member 16.

When the eraser holder 17 is turned slightly from the position abutting on the rear end face 32 and the control pin 18 is in a position facing the opening part of the rear end of the guide grooves 31, it becomes possible to fit the control pin 18 in the guide grooves 31. Accordingly, in this state, when the knocking member 16 is knocked to advance, the control pin 18 enters the guide grooves 31 in response to this advance movement and the eraser holder 17 can advance. Further, when the eraser holder 17 is retracted in the writing instrument body 1 and the knocking member 16 is turned to engage the locking projections 28 with the holding grooves 29, a retain hole 33 is provided to lock the control pin 18 in the guide grooves 31 at the position facing the outward end of the control pin 18. When the control pin 18 is locked in the retain hole 33, movement of the eraser holder 17 in the forward and backward direction can be prevented.

As shown in FIGS. 3A, 3B, 3C and 3D, the knocking member 16 is formed in a tubular shape having an inner wall 34 and is insertable into the knocking holder 15 and urged rearwardly by a knock spring 37 installed between a rear stepped part 35 of a front end tubular part 25 of the knocking member 16 and an inner stepped part 36 of the knocking holder 15 (see FIG. 1). At an intermediate tubular part 38 behind the front end tubular part 25 are provided the locking projections 28 which fit in the knocking grooves 27 formed on the knocking holder 15.

Further, in the longitudinal direction of the intermediate tubular part 38, sliding grooves 39 extending in the forward and backward direction are arranged facing each other so that the control pin 18 and the movable stopper 19 can freely slide therein by their own weights. At the rear end of each sliding groove 39, a locking groove 40 extending in a circumferential direction is provided. It is preferred that, as shown in FIG. 3A, each locking groove 40 extends in a circumferential direction while inclining rearwardly relative to an imaginary central axis of the knocking member 16 so that when the front end of the writing instrument body 1 is oriented to face upward, the control pin 18 dropping by its own weight can smoothly enter the locking grooves 40. Further, when the knocking member 16 is assembled in the knocking holder 15, the position of the locking grooves 40 are adjusted so that the locking grooves 40 will be located at the same position as the rear end face 32 of the knocking holder 15 or a position rearward from the rear end face.

At the rear portion of the intermediate tubular part 38, a rearward tubular part 41 for receiving the eraser holder 17 is formed, and the outer periphery of the rearward tubular part 41 is in slidably contact with the rear inner face of the writing instrument body 1. At an inner face front part 42 of the rearward tubular part 41, at the position corresponding to the rear end of the sliding grooves 39, a groove-shaped guide part 44 is provided to guide the insertion of the control pin 18 and a stopper piece 43 formed on the movable stopper 19 as described below.

Referring to FIGS. 4A, 4B and 4C, the eraser holder 17 is formed in a tubular shape in such a size that it can be housed in the rearward tubular part 41 of the knocking member 16, and its rear side is formed as a large-diameter part 45 to which the eraser 14 can be attached. On the inner face of the large-diameter part 45, an eraser detachment-preventing projection 46 is formed. The peripheral wall of the eraser holder 17 has a cutout groove 47 so that when the eraser 14 is consumed, the residue of the eraser can be scraped out and exchanged for a new eraser. A small-diameter part 48 extends frontward from the large-diameter part 45 and is designed to have an inner diameter configured to receive therein a protruding part 49 (see FIG. 5A) of the control pin 18 as described below, and at its front end side, an installing hole 51 opening in a substantially U-character shape is formed to hold a projection piece 50 formed at the control pin 18 as described below.

Referring to FIGS. 5A, 5B and 5C, the control pin 18 has a protruding part 49 insertable into the small-diameter part 48 of the eraser holder 17 and a lateral crosspiece 50 extending in a substantially T-character shape so that opposite ends of the crosspiece can be fitted in the sliding grooves 39 formed in the knocking holder 15. The crosspiece 50 may have a cross section of a substantially circular shape. However, in this embodiment, the crosspiece has a cross section of a substantially oval shape (see FIG. 7C), by which when the control pin 18 moves in the sliding grooves 39 by its own weight, it can move in slidable contact with the sliding grooves 39 in a stable state.

The front end of the control pin 18, i.e., the crosspiece 50, extends in the radial direction of both the knocking member 16 and the knocking holder 15 and protrudes radially outwardly beyond the outer periphery face of the intermediate tubular part 38 of the knocking member 16. Further, the front end of the control pin 18 (the crosspiece 50) has a diameter length longer than the inner diameter length of the knocking holder 15 so that it can extend into and slidably move in the frontward and backward direction along the guide grooves 31 provided on the inner face of the knocking holder 15. However, the front end of the control pin 18 (the crosspiece 50) is designed to have such a diameter length that does not exceed the outer diameter of the rear end face 32 of the knocking holder 15, but is sufficient to allow the front end of the crosspiece 50 to slip out of the guide grooves 31 at the inner face of the knocking holder 15 and abut the rear end face 32 of the knocking holder 15, when the control pin 18 enters the locking groove 40 from the sliding grooves 39.

Referring to FIGS. 6A, 6B, 6C and 6D, the movable stopper 19 has a stopper body 52 in a circular column shape having a weight sufficient to enable it to move in a forward and backward direction by its own weight when it is inserted into the intermediate tubular part 38 of the knocking member 16. Two stopper pieces 43 extend radially outwardly on the peripheral face of the stopper body 52 and are slidably inserted in the respective sliding grooves 39 and can freely move in the forward and backward direction therein. A rear end part 53 of each stopper piece 43 is formed in a slanting edge shape to securely close the opening part at which the sliding grooves 39 connect to the locking groove 40. At the central part of the stopper body 52, a through hole 54 is formed to enable the movable stopper 19 to easily move by dropping due to its own weight.

The knocking member 16 may be assembled by inserting the movable stopper 19 and the control pin 18 through the guide part 44 of the knocking member 16 into the inside thereof, fitting the stopper pieces 43 in the sliding grooves 39, and then fitting the crosspiece 50 of the control pin 18 in the sliding grooves 39, and from its rearward side, inserting the eraser holder 17, inserting the protruding part 49 of the control pin 18 into the small-diameter portion 48 of the eraser holder 17, and engaging the periphery of the crosspiece 50 with the installing hole 51 of the eraser holder 17.

As shown in FIG. 1, when a user holds the writing instrument body 1 inclined downwardly for writing so that the tapered tip 9 side at the front end of the writing instrument body 1 faces a paper or other writing surface, the eraser holder 17 to which the control pin 18 is fixed moves forward by its own weight and is housed in the rearward tubular part 41 of the knocking member 16, and the movable stopper 19 abuts on the inner wall 34 of the knocking member 16 and stops. In this state, when the knocking member 16 is knocked, the knocking member 16 moves forward along the knocking groove 27 and presses the rear end of the lead tank 5, and in the same manner as with usual knocking-type feeding mechanisms, the chuck 6 is allowed to move forward, thereby feeding the lead 4 for writing.

When the eraser 14 is used, the writing instrument body 1 is inclined upwardly (reversed) so that the eraser 14 side faces downwardly. By this reverse operation, the eraser holder 17 and the movable stopper 19 drop together downwardly by their own weight in the knocking member 16. FIG. 7A is an explanatory view showing a state before dropping movement of the eraser holder 17 and the movable stopper 19. In this state before movement, as shown in FIG. 7B, the outward ends of the crosspiece 50 of the control pin 18 are fitted in the guide grooves 31 of the knocking holder 15, and at the same time, as shown in FIG. 7C, the crosspiece 50 is fitted in the sliding grooves 39 of the knocking member 16. In FIG. 7C, the movable stopper 19 is located above the control pin 18 and the lower end thereof abuts on the control pin 18.

By orienting the eraser 14 side to face downwardly, as shown in FIG. 8A, the eraser holder 17 moves downwardly by its own weight and the eraser 14 protrudes from the rearward tubular part 41 of the knocking member 16. And, as shown in FIG. 8C, the control pin 18 drops to the downward side of the sliding grooves 39, and at the same time, the movable stopper 19 also drops. When the control pin 18 drops to the rear end of the sliding grooves 39, the crosspiece 50 of the control pin 18 enters the locking groove 40 and the eraser holder 17 slightly turns along the locking groove 40. Afterward, at the opening part of the locking groove 40, the stopper piece 43 of the movable stopper 19 which has subsequently dropped stops alongside of and adjacent to the crosspiece 50 of the control pin 18, thereby closing the opening part of the locking groove 40. At this moment, the outward end of the control pin 18, i.e. the ends of the crosspiece 50, slips out of the rear end of the guide grooves 31 of the knocking holder 15, and as shown in FIG. 8B, by the slight rotation of the eraser holder 17, turns and moves to the position facing the rear end face 32 of the knocking holder 15, resulting in the state as shown in FIG. 8A.

In this state, when the eraser 14 is pressed against a paper or other writing surface 55 as shown in FIG. 9A, the stopper pieces 43 of the movable stopper 19 are located adjacent to the crosspiece 50 of the control pin 18 as shown in FIG. 8C, and therefore the eraser holder 17 does not return to the inside of the knocking member 16, but when the eraser 14 is pressed further, the entire knocking member is forced to move forward and retract into the writing instrument body. However, as shown in FIGS. 9A and 9B, the crosspiece 50 of the control pin 18 abuts on the rear end face 32 of the knocking holder 15, i.e. an abutment part, and therefore both the knocking member 16 and the eraser holder 17 do not move forward. As explained above, since the advance movement of the knocking member, i.e. the knocking operation, can be prevented, feeding of the lead can be prevented and the eraser can be used safely.

From the state as shown in FIG. 9A, when the writing instrument body 1 is oriented downwardly so that the eraser 14 is located upward, the stopper pieces 43 of the movable stopper 19 are guided to the sliding grooves 39 and return to the state shown in FIG. 7C, thereby opening the opening part of the locking groove 40 of the knocking member 16, and therefore the crosspiece 50 of the control pin 18 also slips out of the locking groove 40 and returns to the original position, and the eraser 14 is housed in the knocking member 16. And, since the writing instrument returns to the state shown in FIG. 1, a knocking operation can be made.

In the state shown in FIG. 1, the knocking member 16 retracts in the knocking holder 15 by being urged by the knock spring 37, and the locking projections 28 are located adjacent to the holding grooves 29 of the knocking holder 15. In this state, when the knocking member 16 is turned, the locking projections 28 are fitted in the holding grooves 29, and concurrently, the outward end of the control pin 18 provided at the eraser holder 17 engages with the retain hole 33 formed on the inner face of the knocking holder 15. Accordingly, the writing instrument may be designed so that the knocking member 16 and the eraser holder 17 will not come out of the writing instrument body when it is carried. If the projection/retraction of the eraser is troublesome, transfer of the knocking member can be stopped.

Figure 10:
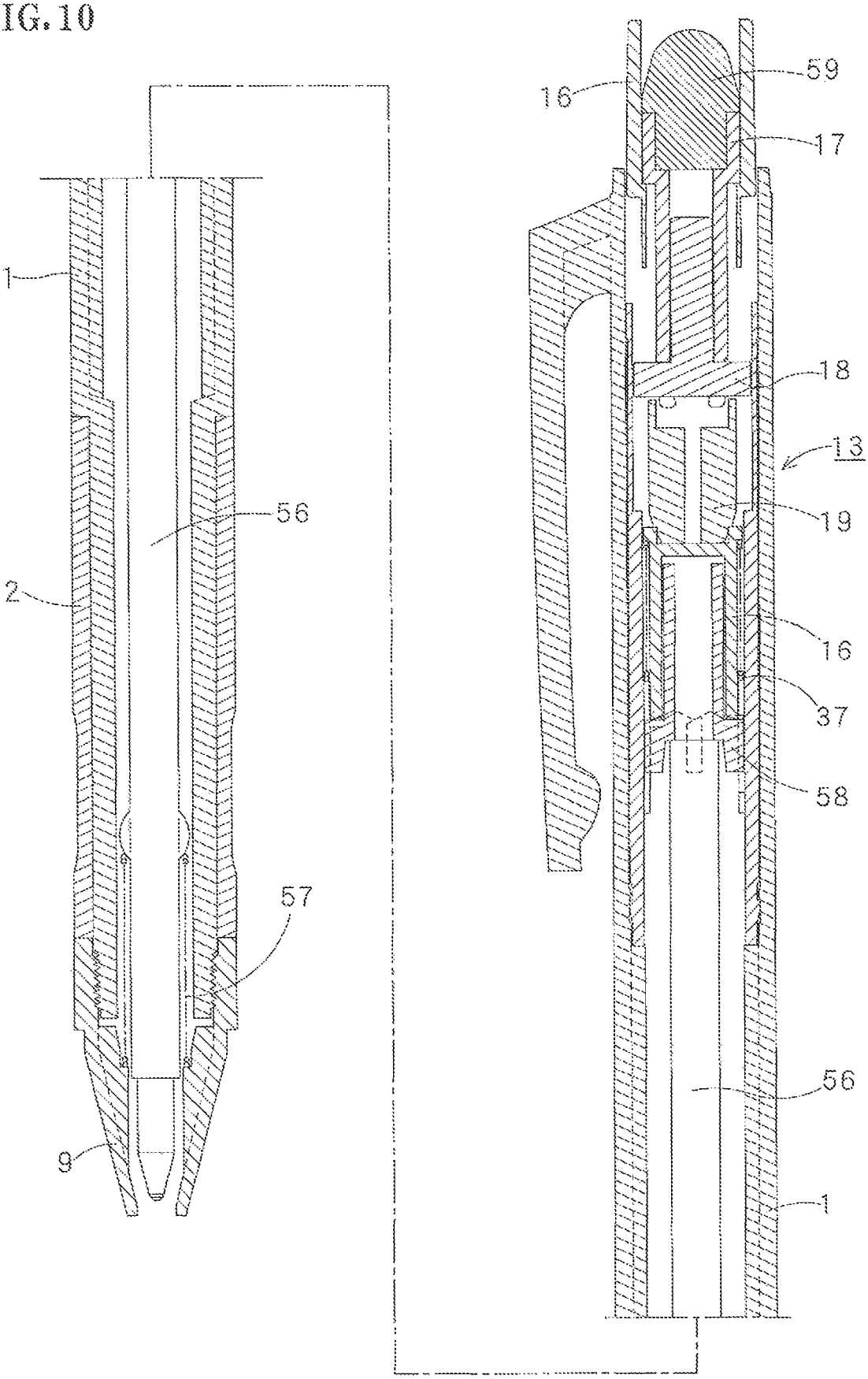
FIG. 10 is a cross-sectional view showing another example of a writing instrument according to the present invention, wherein the writing instrument is a ball point pen and a pen refill is used as the refill.

The above example describes an embodiment where the present invention is applied to a writing instrument in the form of a mechanical pencil having a refill lead as the refill. FIG. 10 shows an example of another embodiment where the present invention is applied to a writing instrument in the form of an erasable ball point pen having an ink refill as the refill. In FIG. 10 and the subsequent Figures, parts that are the same as parts described above in connection with FIGS. 1-9 are denoted by the same reference numerals and a description thereof has been omitted in the following description.

In FIG. 10, a ball point pen ink refill 56 (sometimes referred to as simply "refill") is urged by a return spring 57 so that the tip of the refill is retracted into the tapered tip 9, and at the rear end of the refill 56, a well-known knocking-type feeding mechanism is provided. In this feeding mechanism, as known in the art, a knocking cam is moved forward by a knocking operation and a rotation cam abutting on the rear end of a refill is moved forward or backward in relation to a fixed cam provided in the writing instrument body, by which the refill is projected or retracted. Since this mechanism is well known in the art, a detailed description thereof is omitted. The eraser project/retract mechanism 13 is the same as that described above in connection with the embodiment illustrated in FIGS. 1-10 except for the points that a knocking cam 58 is fixed at the front part of the knocking member 16 and an eraser 59 for erasing what is written by an erasable ball point pen is used as an eraser, and a description of this mechanism is also omitted. In this embodiment also, if the eraser 59 side is oriented to face downward, the eraser holder 17 projects rearward, and the knocking member is locked so that it will not retract into the writing instrument body 1 and the eraser can be used in this state.

In the above embodiments, an explanation is made for an example in which the eraser projects from and retracts into the knocking member, but the present invention may be applied to a writing instrument having an eraser attached to a knocking member in a fixed state. An example of one such embodiment is described below with reference to FIGS. 11-18C which show a writing instrument in the form of a mechanical pencil.

Figure 11:
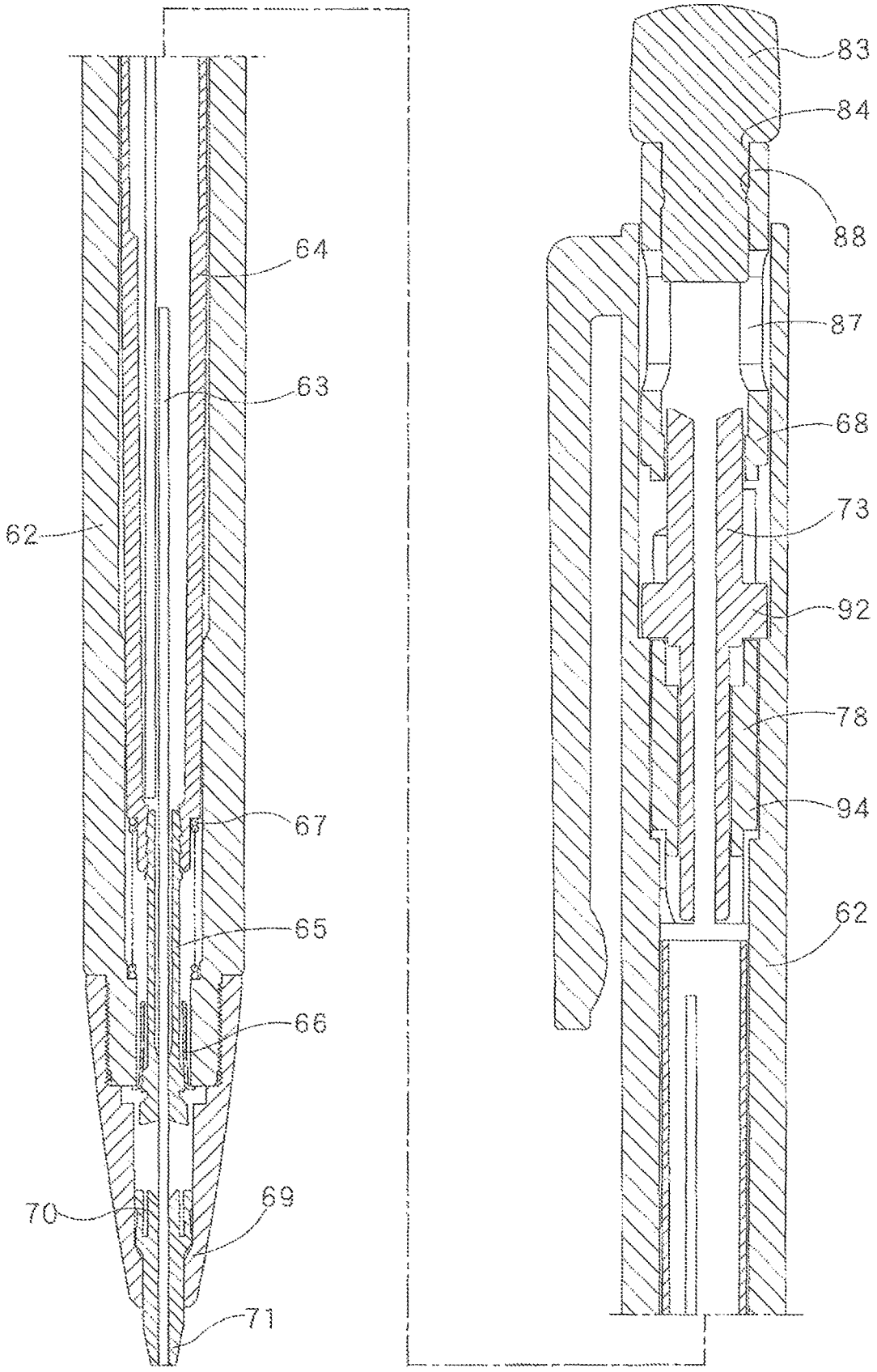
FIG. 11 is a cross-sectional view showing another example of a writing instrument in the form of a mechanical pencil according to the present invention, showing the writing instrument in a writing state.

As shown in FIG. 11, the writing instrument comprises a writing instrument body 62 which houses a lead tank 64 that stores refill leads 63. In front of the lead tank 64 are a chuck 65 for gripping a lead 63 fed from the lead tank 64 and a clutch 66 for fastening the chuck 65. The lead tank 64 is urged rearwardly by a chuck spring 67. At the rear of the lead tank 64, a knocking member 68 is provided facing the rear end of the lead tank 64. From a tapered tip 69 provided at the front end of the writing instrument body 62, a slider 71 having a guide tube 70 for temporarily holding and guiding the fed lead 63 projects from the front end of the writing instrument. When the knocking member 68 is knocked, the chuck 65 advances while gripping the lead 63 fed from the lead tank 64, and during advancement of the lead, the clutch 66 abuts on a stepped part provided in the tapered tip 69 to release the chuck 65, and as known in the art, the lead 63 is fed from the front end in readiness for writing.

Figure 12A:
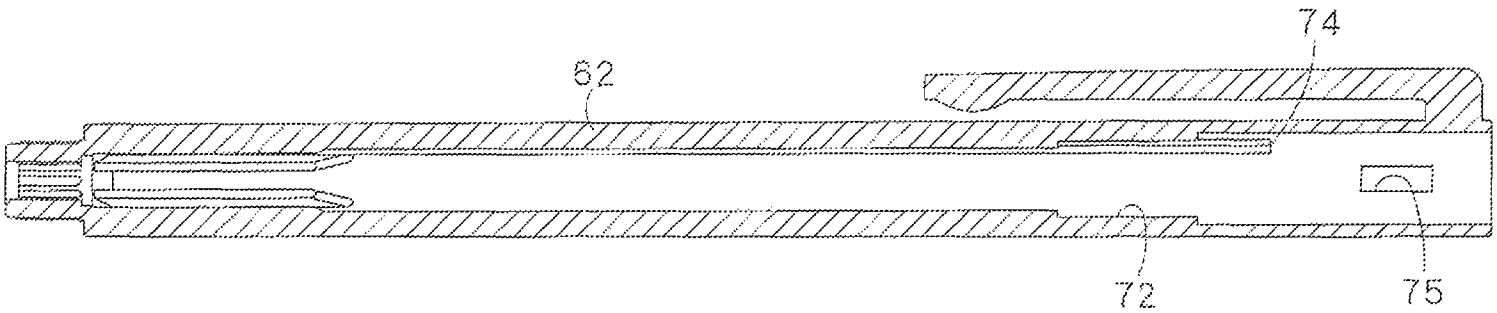
Figure 12B:
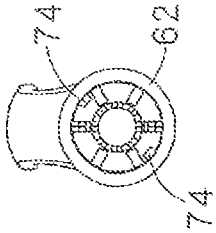
Figure 13:
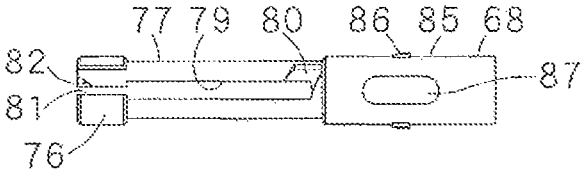
FIGS. 13A-13C show a knocking member, where
Figure 13:
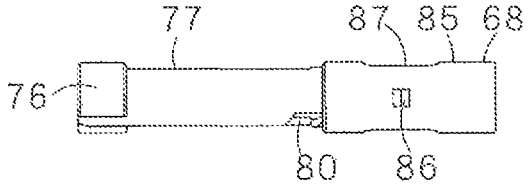
Figure 13:
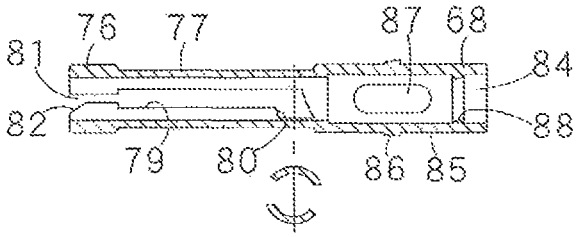
Figure 14:
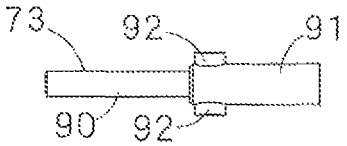
Figure 14:
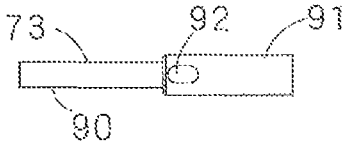
Figure 14:
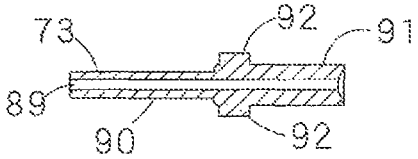
Figure 15:
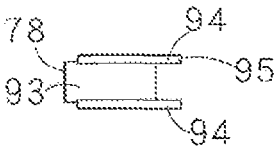
Figure 15:
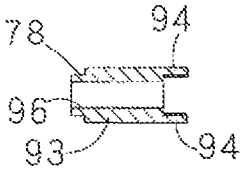
Figure 15:
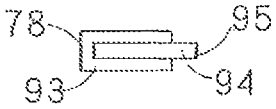
Figure 15:
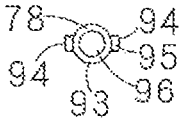
Figure 16:
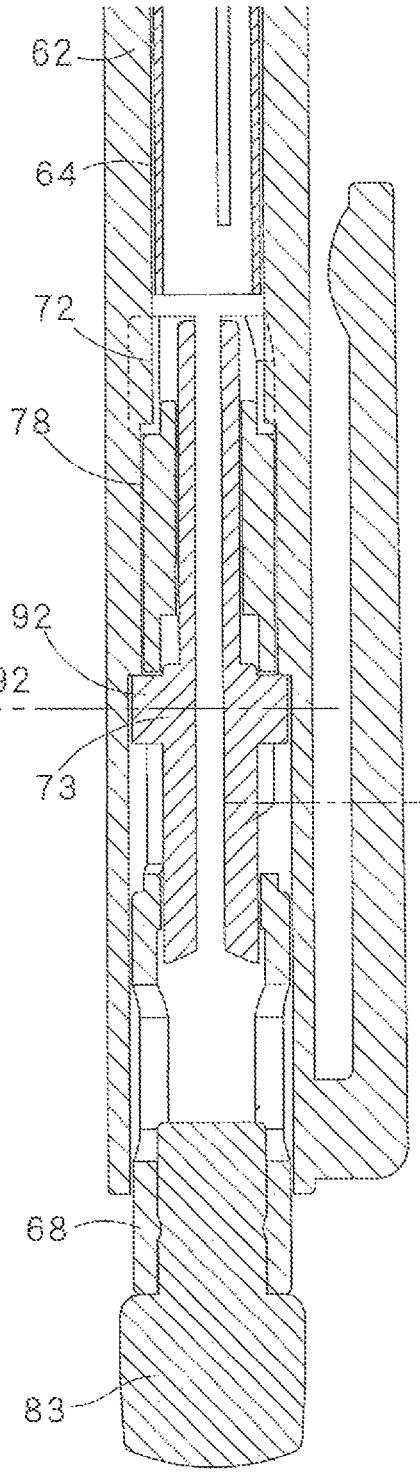
Figure 16:
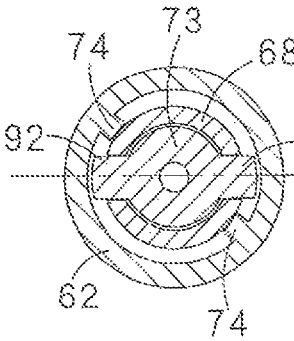
Figure 16:
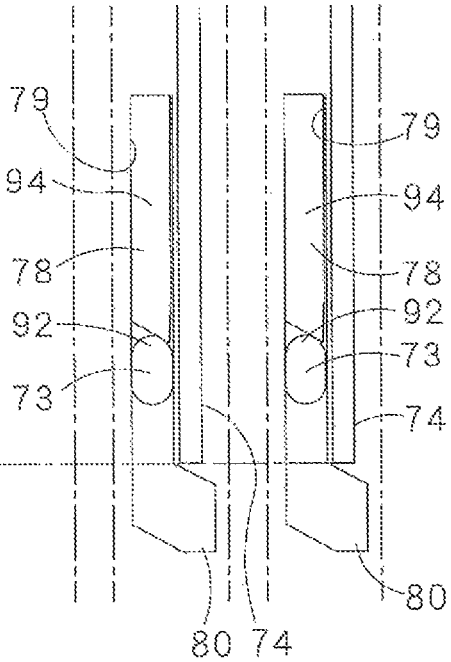
Figure 17:
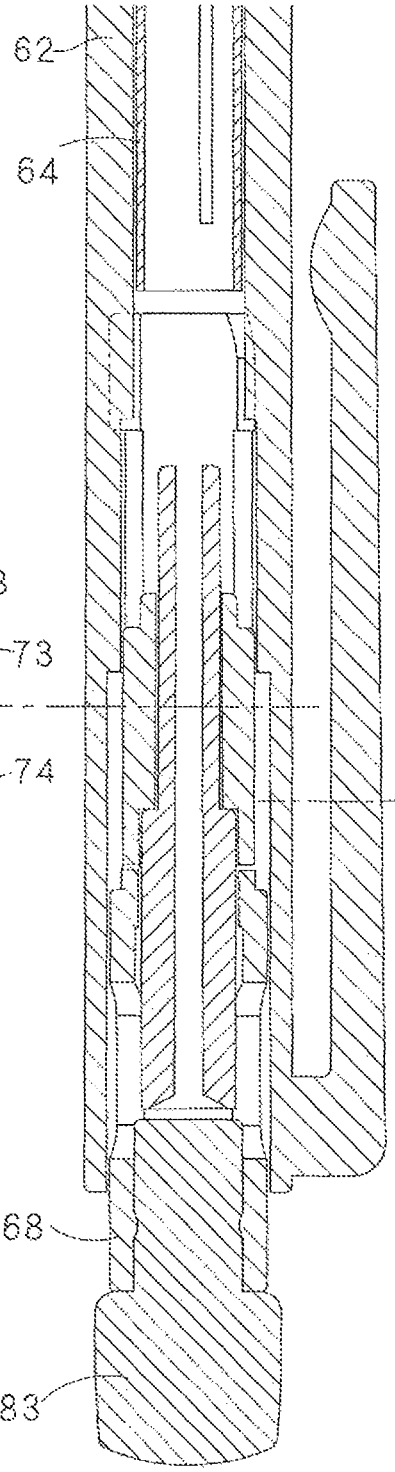
Figure 17:
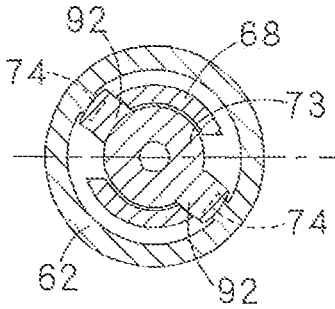
Figure 17:
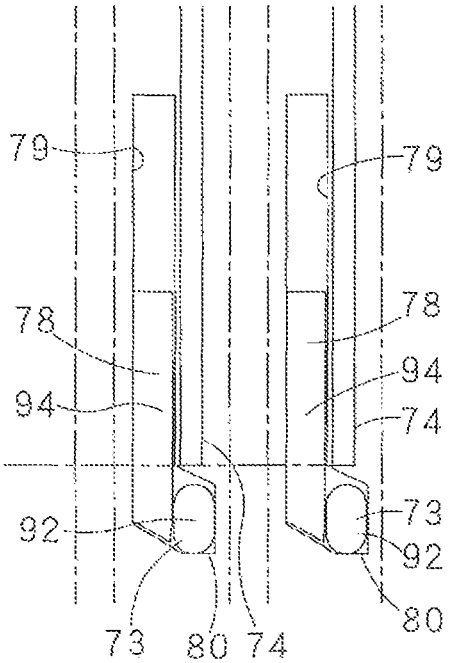
Figure 18:
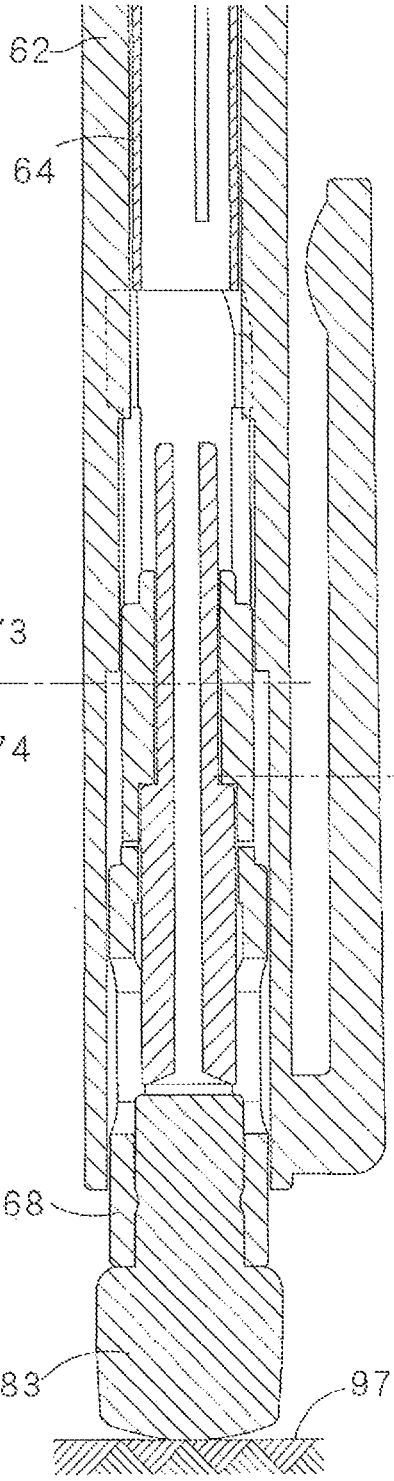
Figure 18:
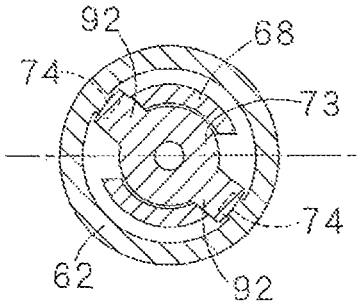
Figure 18:
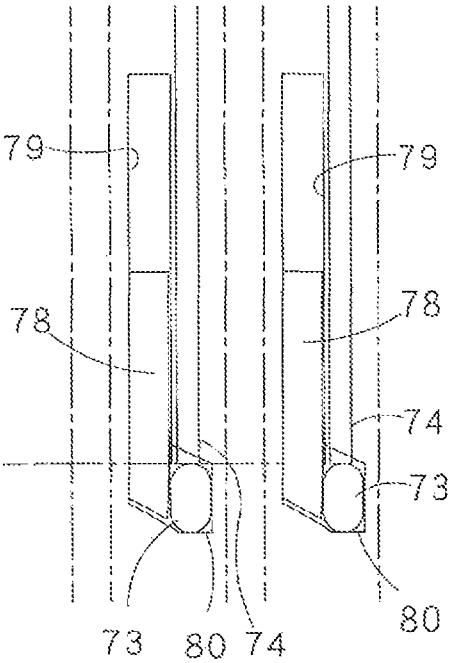

As shown in FIGS. 12A and 12B, at a part facing the knocking member 68 in the writing instrument body 62, a knock rib 72 for guiding the straight movement of the knocking member 68 is provided, and on the rearward side of the knock rib, abutment ribs 74 are provided as abutment parts for limiting the advance movement of a control pin 73. Further, at the rear part of the body 62, two opposed knocking grooves 75 for controlling the movement of the knocking member 68 are provided.

As shown in FIGS. 13A-13C, the knocking member 68 is formed in a tubular shape and has at its front end a head part 76 configured to be brought into slidable contact with the inner face of the writing instrument body 62. In this example, unlike the above-mentioned examples, no knock spring for urging the knocking member 68 rearwardly is provided, but if a particular case requires, any suitable knock spring (not shown) for urging the knocking member rearwardly may be provided.

The knocking member 68 has an intermediate tubular part 77 having a diameter smaller than that of the head part 76, sliding grooves 79 are formed to face each other and extend in the forward and backward direction so that a control pin 73 and a movable stopper 78 can freely slidably move therein by their own weights. At the rear end of each sliding groove 79, a locking groove 80 extending in a circumferential direction is provided. As shown in FIGS. 13A-13C, it is preferred that the locking grooves 80 extend in a circumferential direction inclining rearwardly relative to an imaginary central axis of the knocking member 68 so that the control pin 73 dropping by its own weight can smoothly enter the locking grooves 80. The position of the locking grooves 80 is adjusted so that the locking grooves 80 will be located at the same position as the abutment ribs 74 formed on the inner face of the writing instrument body 62 or at a position rearward from the abutment ribs 74, when the knocking member 68 is assembled in the writing instrument body 62. At the front end side of the sliding grooves 79, a slit 81 which opens toward the forward direction is provided, and the slit 81 is fitted in the knock rib 72 provided in the writing instrument body 62. At the front end of the slit 81, a slanting face 82 is provided to guide the insertion of the control pin 73 and the movable stopper 78 into the knocking member 68.

Behind the intermediate tubular part 77, a rearward tubular part 85 is formed which has an installing hole 84 for attaching an eraser 83 in a fixed state. On the outer periphery of the rearward tubular part 85, are provided locking projections 86 which engage with the knocking grooves 75 formed on the writing instrument body 62 and a through hole 87. The rearward tubular part 85 is brought into slidable contact with the rear inner face of the writing instrument body 62 in a state where the locking projections 86 are engaged with the knocking grooves 75. On the inner face of the rearward tubular part 85, an annular ring 88 is formed to prevent detachment of the eraser 83. The locking projections 86 and the knocking grooves 75 may be provided on the side reverse to the ones in the example shown in this figure, namely, the locking projections 86 may be provided on the writing instrument body side and the knocking grooves 75 may be provided on the knocking member side (not shown).

As shown in FIGS. 14A-14C, the control pin 73 is formed in a tubular shape having a through hole 89 for lead-feeding. The control pin 73 has a front part 90 formed to have an outer diameter so that it can be inserted into the movable stopper 78, and a rear part 91 formed to have an outer diameter so that it is in slidable contact with the rearward tubular part 85 of the knocking member 68, by which the control pin 73 can move freely in the forward and backward direction in the knocking member 68. On the front end side of the rear part 91, two projections 92 are formed to extend in a substantially T-character shape in the radial direction of the writing instrument body 62 so as to be fitted in respective sliding grooves 79 of the knocking member 68.

The projections 92 may have a cross section of a substantially circular shape, but in the example shown in FIGS. 14A-14C, they are designed to have a plane part on opposite sides and a cross section of a substantially oval shape so that when the projections move in the sliding grooves 79 by their own weight, they move in slidable contact with the sliding grooves 79 in a stable state. The outward end of the control pin 73, i.e., the outward ends of the projections 92, are formed to have a length that protrudes outwardly from the outer periphery of the intermediate tubular part 77 of the knocking member 68, and also to have a length such that the projections 92 do not touch the inner face of the writing instrument body 62 but are capable of abutting the rear end faces of the abutment ribs (abutment parts) 74 protruding from the inner face of the writing instrument body 62.

As shown in FIGS. 15A-15D, the movable stopper 78 is inserted into the intermediate tubular part 77 of the knocking member 68 and has a stopper body 93 of a tubular shape having such a weight that it can move in the forward and backward direction by its own weight. On the peripheral face of the stopper body 93, two stopper pieces 94 are provided, which are inserted in respective sliding grooves 79 and can freely move in the forward and backward direction therein. A rear end part 95 of each stopper piece 94 is formed in a slanting edge shape so that it can securely close the opening part of the locking groove 80 where the sliding grooves 79 connect to the locking groove 80. In the stopper body 93, a through hole 96 is formed through which the front part 90 of the control pin 73 passes.

In the case where the writing instrument is a mechanical pencil, as shown in FIG. 11, when the writing instrument body 62 is held by a user to face downward so that the slider 71 side, i.e., the front end of the writing instrument body 62, faces a paper or other writing surface in readiness for writing, the locking projections 86 of the knocking member 68 are located at the rear end side of the knocking grooves 75 of the writing instrument body 62. The control pin 73 and the movable stopper 78 are moved forward by their own weights and do not constrain the movement of the knocking member 68. In this state, when the knocking member 68 is knocked, the knocking member 68 moves forward guided by the knock rib 72 and press the rear end of the lead tank 64, by which as in usual knocking-type feeding mechanisms, the chuck 65 is advanced and the lead 63 is fed for writing.

When the eraser 83 is used, the writing instrument body 62 is inclined (inverted) to face upward so that the eraser side faces downward. By this inverting operation, the control pin 73 and the movable stopper 78 drop together downwardly along the sliding grooves 79 in the knocking member 68. FIGS. 16A-16C are explanatory views showing a state before the movement by dropping. In this state before the movement, as shown in FIG. 16B, the outward ends of the projections 92 of the control pin 73 protrude in the radial direction of the knocking member 68, but do not face the abutment parts 74. As shown in FIG. 16C, each projection 92 is fitted in a sliding groove 79 of the knocking member 68. In FIG. 16C, the movable stopper 78 is located above the control pin 73 and the lower end of the movable stopper 78 abuts on the control pin 73.

By orienting the eraser 83 side downward, as shown in FIGS. 17A and 17C, the control pin 73 drops to the downward side of the sliding grooves 79 and at the same time, the movable stopper 78 also drops. When the control pin 73 drops to the rear end of the sliding grooves 79, the control pin 73 turns slightly along the locking groove 80 and concurrently the projections 92 enter the locking groove 80. Then, at the opening part of the locking groove 80, the stopper piece 94 of the movable stopper 78 that has subsequently dropped afterward stops alongside of and adjacent to the projections 92 of the control pin 73, by which the opening part of the locking groove 80 is closed. By the rotation of the control pin 73, the outward ends of the projections 92 of the control pin 73 move to the position facing the abutment parts 74 formed in the writing instrument body 62 as shown in FIG. 17B.

In this state, when the eraser 83 is pressed against a paper 97 as shown in FIG. 18A, since the stopper piece 94 of the movable stopper 78 is located adjacent to the projections 92 of the control pin 73 as shown in FIG. 17C, the projections 92 of the control pin 73 do not return to the inside of the sliding grooves 79 of the knocking member 68, but when the eraser 83 is pressed further, the entire knocking member 68 is forced to move forward and retract into the writing instrument body. However, as shown in FIGS. 18A and 18B, the outward ends of the projections 92 of the control pin 73 abut on the rear end faces of the rib parts 74 (abutment parts) by which the knocking member 68 does not move forward. As explained above, the advance movement of the knocking member 68, i.e., the knocking operation, can be prevented, and therefore the feeding of the lead can be prevented and the eraser 83 can be used safely.

When the writing instrument body 62 is shifted downwardly from the state shown in FIG. 18A so that the eraser 83 is oriented to face upward, the movable stopper 78 returns to the state shown in FIG. 16C guided by the sliding grooves 79, thereby opening the opening part of the locking groove 80 of the knocking member 68. Therefore, the projections 92 of the control pin 73 slip out of the locking groove 80 and enter the sliding grooves 79, by which the writing instrument body comes into the state as shown in FIG. 11 and therefore the knocking operation becomes possible.

As will be apparent to persons skilled in the art, the embodiment described above with reference to FIGS. 11-18C for a mechanical pencil is applicable as well to a ball point pen.

It will be appreciated by those of ordinary skill in the art that obvious changes, alterations and modifications can be made to the examples and embodiments described in the foregoing description without departing from the broad inventive concept thereof. It is understood, therefore, that this disclosure is not limited to the particular examples and embodiments disclosed, but is intended to cover all obvious changes, alterations and modifications thereof which are within the scope and spirit of the disclosure as defined by the appended claims.

What is claimed is:

1. A knocking-type writing instrument equipped with an eraser, comprising: a writing instrument body which houses a refill; a knocking member inserted into the writing instrument body to undergo forward and backward movement to forwardly advance the refill, the knocking member having a sliding groove which extends in a forward and backward direction, and a locking groove which extends in a circumferential direction from a rear end of the sliding groove; an eraser held at a rear part of the knocking member; a control pin movable between the sliding groove and the locking groove of the knocking member, the control pin having an outward end which extends in a radial direction of the writing instrument body and which is slidably engageable with the sliding groove and the locking groove; a movable stopper inserted into a forward side of the sliding groove forward of the control pin, the movable stopper being freely movable in the forward and backward direction in the sliding groove; and an abutment part provided in the writing instrument body to prevent forward movement of the control pin when the control pin is positioned in the locking groove.

2. The knocking-type writing instrument equipped with an eraser according to claim 1; wherein the locking groove is located at the same position as the abutment part or at a position rearward from the abutment part.

3. The knocking-type writing instrument equipped with an eraser according to claim 1; wherein the locking groove is inclined rearwardly relative to a longitudinal axis of the writing instrument body.

4. The knocking-type writing instrument equipped with an eraser according to claim 1, further comprising a knocking holder fixed at a rear part of the writing instrument body, a knock spring which urges the knocking member rearwardly, and an eraser holder which is inserted freely movably in a forward and backward direction at a rear part of the knocking member and which holds the eraser, wherein when the control pin is positioned in the locking groove, a rear end face of the knocking holder constitutes the abutment part on which the outward end of the control pin abuts.

5. The knocking-type writing instrument equipped with an eraser according to claim 4; wherein at either one of the knocking holder and the knocking member, a knocking groove extending in a forward and backward direction is provided for controlling a range of movement of the knocking member, and at the other one of the knocking holder and the knocking member, a locking projection is provided to be inserted into the knocking groove, and the eraser is provided retractably from the rear part of the knocking member.

6. The knocking-type writing instrument equipped with an eraser according to claim 5; wherein at a rear end of the knocking groove, a holding groove is provided which extends in a circumferential direction of the writing instrument body and in which the locking projection is engageable; on an inner face of the knocking holder, a guide groove extending in a forward and backward direction is provided for slidably receiving therein the control pin; and in the guide groove, a retain hole is provided for engagement with the control pin when the locking projection is engaged with the holding groove.

7. The knocking-type writing instrument equipped with an eraser according to claim 1; wherein the knocking member has an installing hole at a rear part thereof, and the eraser is attached in the installing hole in a fixed state.

8. The knocking-type writing instrument equipped with an eraser according to claim 7; wherein the writing instrument body has an abutment rib having a rear end face positioned so that the control pin abuts thereon when the control pin is positioned in the locking groove, and the rear end face of the abutment rib constitutes the abutment part.

* * * * *